United States Patent [19]

Perez

[11] Patent Number: 4,545,528

[45] Date of Patent: Oct. 8, 1985

[54] SPRINKLER CONTROL SYSTEM

[76] Inventor: Paul S. Perez, 6844 First St. & Trans-Mountain, Canutillo, Tex. 79835

[21] Appl. No.: 505,953

[22] Filed: Jun. 20, 1983

[51] Int. Cl.[4] ..... B05B 1/02

[52] U.S. Cl. ..... 239/1; 137/132; 137/391; 137/393; 239/65; 239/208; 239/DIG. 1

[58] Field of Search ..... 137/132, 135, 391, 393, 137/433; 239/65, 208, DIG. 1, 1, 11

[56] References Cited

U.S. PATENT DOCUMENTS

| | | | |
|---|---|---|---|
| 910,400 | 1/1909 | Lischer . | |
| 1,421,531 | 7/1922 | Moras | 137/135 X |
| 1,693,556 | 11/1928 | Spencer . | |
| 1,796,940 | 3/1931 | Pottenger, Jr. . | |
| 1,796,941 | 3/1931 | Pottenger, Jr. . | |
| 2,149,899 | 3/1939 | Pfeffer | 239/65 |
| 2,865,674 | 12/1958 | Jelmeland . | |
| 2,930,393 | 3/1960 | Starling | 137/433 X |
| 3,045,699 | 7/1962 | Childers | 239/65 X |
| 3,747,858 | 7/1973 | Krynicki | 239/99 |

*Primary Examiner*—Andres Kashnikow

*Attorney, Agent, or Firm*—Richards, Harris, Medlock & Andrews

[57] ABSTRACT

A spray system is provided for distributing fluid over a selected area through a distribution header to spray units. A control unit uses a siphon loop to continuously cycle an internal water level between two elevations. A water level float provides an output for actuating a valve effective to vary fluid pressure in the distribution header and affect a sweeping of the spray produced by the spray units. The fill rate of the control unit may be varied to change the sweeping rate of the spray through the spray units.

10 Claims, 3 Drawing Figures

SPRINKLER CONTROL SYSTEM

FIELD OF INVENTION

This invention relates to control systems for affecting fluid pressure in a fluid distribution system and, more particularily, relates to a water sprinkling system having a control unit for producing a sweeping action of the water spray over a selected area.

BACKGROUND OF INVENTION

Fluid distribution systems are frequently installed to deliver a fluid, such as water, to one or more spraying units. Conventional uses for such spraying units include area irrigation, fire extinguishing and cooling by spray evaporation. In addition, conventional distribution systems which provide water to the spray units may be permanently buried or elevated above ground level.

Spraying units are usually required to evenly distribute the water over a selected area. The spray distribution is normally affected by the spray head or nozzle. Stationary spray heads may be used to produce a continuous spray configured to cover an area. Rotating spray heads may be used to produce a radial spray which is rotated through an arc effective to cover an area. In both cases, however, radial distribution is continuous and uniform distribution is difficult to achieve.

In order to improve spray distribution uniformity along a radial direction, systems have been developed to sweep the spray along a radial direction. For example, U.S. Pat. Nos. 1,796,940 and 1,796,941, both to Pottenger, disclose spring actuated control systems cooperating with distribution system pressure to obtain internal valve movements affecting water pressure forcing the spray units to obtain a sweeping action. These units appear to be mechanically complex with many internal parts exposed to the sprayed fluid and entrained debris.

In another example, U.S. Pat. No. 3,747,858, to Krynicki, discloses a spray head with an internal impeller which is driven by the flowing fluid. The rotating impeller produces a variable orifice and, hence, a variable output pressure forming each spray droplet. The resulting radial sweep may be very rapid and appear to be a uniformly dispersed and continuous spray. The spray head appears to require close tolerances between adjacent parts and to be possibly susceptible to damage from debris passing through the spray head and the rapidly rotating impeller.

Underground fluid distribution systems may be used where the area to be watered permits installation of underground pipes. Back-fit installation or repair of such systems is not always possible because of intervening concrete structure and plant growth. Elevated distribution systems are not suited to cover large yard areas, but are indeed suitable for small yard areas, now increasingly found in town homes, patio homes and affordable single family detached dwellings. Certainly, elevated distribution systems are required for roof-top distribution of water for evaporative cooling or fire extinguishing. Although not impossible, it is difficult to incorporate conventional spray nozzles in an elevated system to obtain the desired uniformity of spray distribution.

The disadvantages of the prior art are overcome by the present invention and improved methods and apparatus are provided to control fluid pressure in a fluid spray system to sweep the spray in a radial direction and to uniformly deliver the spray over a selected area, preferrably through an elevated distribution system.

SUMMARY OF INVENTION

In a preferred embodiment of the present invention, a spray system is provided for distributing fluid over a selected area through a distribution header to spray units. A control unit uses a siphon loop to continuously cycle an internal water level between two elevations. Water level responsive means provides an output for actuating a valve effective to vary fluid pressure in the distribution header and to affect a sweeping of the spray produced by the spray units.

A method is provided for sweeping a selected area with a sprayed fluid by using a control signal generated by periodic filling and draining a container. Draining action is initiated by a siphon loop at a first fluid level and terminated at a second fluid level. A container fill rate is provided less than the drain rate to maintain a continuous control signal. The pressure of the sprayed fluid varies in functional relationship with the control signal, producing a spray sweeping the selected area.

It is a feature of one embodiment of the present invention to produce a control signal from a float at the varying fluid level.

Another feature of an embodiment of the present invention is to distribute the spray fluid through an overhead distribution system.

Yet another feature of an embodiment of the present invention is to conform the sweeping action of the sprayed fluid to a selected configuration.

One other feature of an embodiment of the present invention is to coordinate the fluid delivery pressure and sweep rate to improve the uniformity of delivered fluid.

These and other features and advantages of the present invention will become apparent from the following detailed description, wherein reference is made to the figures in the accompanying drawing.

IN THE DRAWINGS

DETAILED DESCRIPTION

Figure 1:
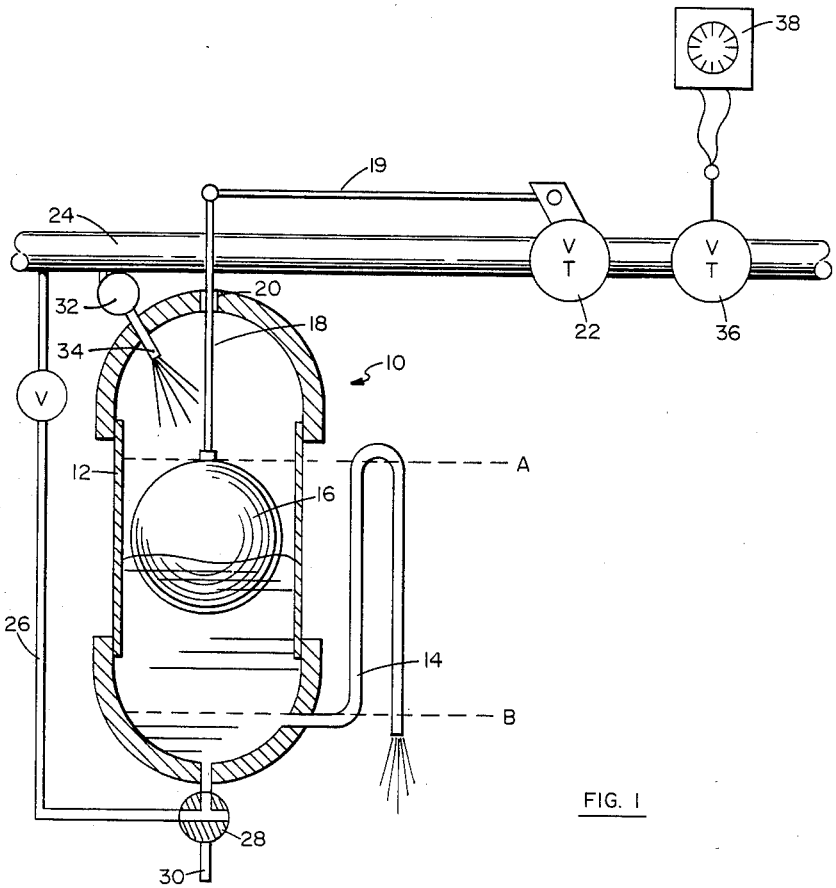
FIG. 1 is a pictorial illustration in partial cross-section of one embodiment of a control unit affecting fluid delivery pressure.

Referring now to FIG. 1, there may be seen one embodiment of a siphon actuated spray controller 10 according to one embodiment of the present invention. Spray controller 10 operates to cycle the fluid pressure in delivery line 24 to produce an oscillating spray at downstream nozzles (not shown).

Controller 10 includes body portion 12 which is substantially watertight and float 16 guided by and floating within body 12. Linkage arms 18 and 19 connect float 16 to throttle valve 22, extending from float 16 through exit hole 20. Exit hole 20 need not be sealed around linkage arm 18, but may permit air to move within and without body 12. Linkage arm 18 exit penetration 20 guides and supports linkage arm 18.

Fill line 26 connects fluid line 24 to body 12 to provide input fluid. Three-way valve 28 connects either fluid line 24 or drain line 30 to body 12 for supplying or draining body 12, respectively. Alternatively, valve 32 may be provided with fill line 34 for introducing a fluid supply through an upper wall of body 12.

In operation, the fluid level in body 12 periodically varies between levels A and B. In a typical sequence, fluid from pipe 24 enters body 12 through fill line 26 or 34, causing the water level to rise in body 12 and in siphon loop 14. When the water level reaches level A, siphon loop 14 is filled and water is drained from body 12 through the siphon action of loop 14.

The rate of fluid draining through siphon loop 14 is coordinated with the rate of fluid entering through fill lines 26 or 34. Thus, the fluid level now falls toward level B. When the fluid level reaches level B, the siphon action is broken as air enters siphon loop 14. If fluid continues to be introduced through fill lines 26 or 34, the fluid level in body 12 and siphon loop 14 begins to rise again and the sequence is repeated.

In one embodiment, float 16 is provided within body 12 and float moves with the water level. Float 16 moves lever arms 18 and 19, which actuate throttle valve 22 to affect the fluid pressure in pipe 24 and thereby the rate of fluid flow. A suitable valve for throttle valve 22 includes a Roberts valve, Model R-400.

It will be apparent from FIG. 1 that throttle valve 22 can be opened by float valve 16 rising or closed by float valve 16 rising, depending upon the mechanical arrangement. If a rising float 16 opens valve 22, then valve 22 is automatically closed if fluid is lost from within body 12.

Conversely, if a rising float 16 closes valve 22, then the use of fill line 26 will obtain a reduced rate of water level increase as the increasing hydrostatic head pressure within body 12 opposes the diminishing line 24 pressure. In this mode, the delivered spray may be better equalized over the entire sweep range. Thus, a generally uniform distribution of fluid is maintained over the selected areas.

It will be apparent that the drain rate through siphon loop 14 must be greater than the inlet flow rate over the entire fluid level range. If not, the fluid level will stabilize at a point where the siphon drain rate is equal to the fluid inlet rate.

In FIG. 1, there may also be seen timer device 38, which may be any suitable timing apparatus which can actuate solenoid valve 36. Timer 38, if installed, permits system operation to occur at predetermined times with no manual input. Solenoid valve 36 could be any conventional throttle valve, however, if manual operation is desired to start and stop the operation of control unit 10.

As hereinabove described for FIG. 1, the main control function is obtained from the periodic cycling of the water level between levels A and B. Although float 16 is a preferred embodiment and is mechanically reliable, a hydraulic mechanism actuated by the varying hydrostatic head pressure within body 12 could be used to control valve 22, if desired. Electro-magnetic apparatus are also available to detect the position of a component floating on the fluid within body 12. If additional control of the sweeping action is needed, a variable siphon 14 could be provided to adjust water level A where the siphon action is initiated.

It is apparent that control unit 10 (FIG. 1) can be used to cycle the fluid pressure and, hence, flow, in most conventional water distribution and sprinkler systems, whether buried or elevated. As the fluid pressure at a spray nozzle varies, the velocity of the ejected fluid varies to produce a sweeping action of the spray over a selected area to be contacted.

Figure 2:
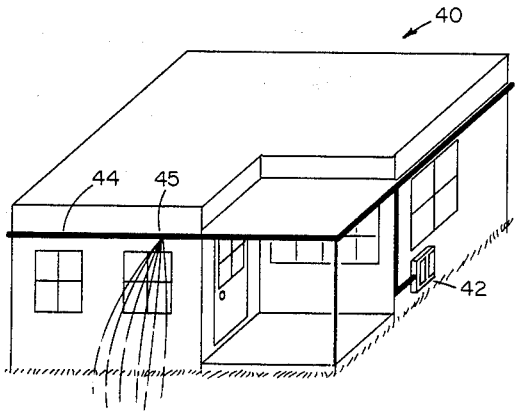
FIG. 2 is a pictorial illustration of an elevated delivery system including a control unit such as described in FIG. 1.

Referring now to FIG. 2, there is shown in pictorial form, an elevated distribution header 44 about building 40. Control unit 42, as hereinabove described in FIG. 1, is preferrably mounted adjacent a water supply exiting building 40 and controls the water pressure in distribution header 44. Distribution header 44 includes a plurality of spray outlet means 45 about the upper periphery of building 40. Spray outlet means 45 may include spray nozzles producing special spray patterns or may include openings in distribution header 44 which are sized and spaced to provide the water distribution over a yard area 48 which is to be watered.

An elevated spray system, as shown in FIG. 2, is particularly suitable for small building plots where conventional water pressure can provide an ejected fluid velocity adequate to reach the plot perimeter with a suitable coverage of water. A new system can be easily installed on existing buildings without the disruptive installation of distribution pipes required by a buried system.

Figure 3:
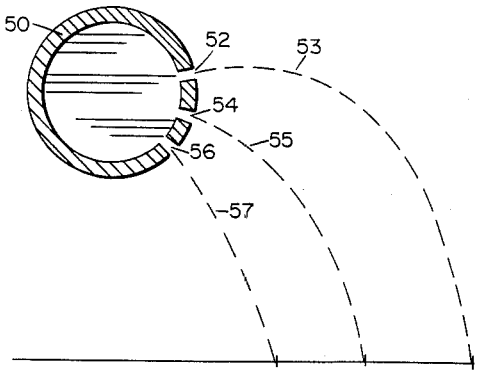
FIG. 3 is a cross-section of fluid delivery pipe illustrating possible spray unit orientations and associated delivery trajectories.

FIG. 3 illustrates, in cross-sectional view, a distribution header pipe 50 with spray outlets 52, 54 and 56 at a variety of angles. Spray outlets 52, 54 and 56 produce ejected fluid arcs 53, 55 and 57 respectively at a given fluid pressure internal to pipe 50. As the fluid pressure decreases, the maximum travel of arcs 53, 55 and 57 will diminish, moving the respective impact points toward pipe 50.

Spray outlets 52, 54 and 56 are usually spaced along a length of pipe 50. The orientation of any selected spray outlet is determined by the specific plot over which the water is distributed. In a preferred installation, pipe 50 is placed about an upper periphery of a building, e.g. building 40 (FIG. 2). Spray outlets 52, 53 or 56 are then located along pipe 50 in a specific arrangement determined by the specific installation.

Thus, a spray arc 53, 55 or 57 can be selected to provide substantially contiguous coverage of the desired adjacent portion of the plot. As shown in FIG. 3, this may be conveniently done by drilling holes in pipe 50 at angles and in diameters to produce the desired arc 53, 55 or 57. The fluid spray may then be formed directly through the holes or spray nozzles may be placed within the holes to provide additional shaping of the projected spray.

The configuration of fill line 26 (FIG. 1) may be altered from the configuration shown in FIG. 1. In one configuration, a throttle valve may be included between pipe 24 and body 12. The fill rate of body 12 may now be adjusted to obtain a desired sweep rate for the spray. Three-way valve 28 may be eliminated if a throttle valve is installed. Then fill line 26 is connected to body 12 with a conventional compression fitting. Body 12 may now be drained by removing the compression fitting.

It is therefore apparent that the present invention is one well adapted to attain all of the objects and advantages hereinabove set forth together with other advantages which will become obvious and inherent from a description of the apparatus and process itself. It will be understood that certain combinations and subcombinations are of utility and may be obtained without reference to other features and subcombinations. This is contemplated by and is within the scope of the present invention.

As many possible embodiments may be made of this invention without departing from the spirit or scope thereof, it is to be understood that all matters herein set forth, in the accompanying drawings are to be interpreted as illustrative and not in any limiting sense.

What is claimed is:

1. A spray system for continuously sweeping a water spray over a selected area, comprising:

water spray forming means having a spray distance functionally related to water pressure, a distribution header for delivering water to said spray forming means, a valve for affecting water pressure within said distribution header to vary said spray distance, and control means having a siphon for cycling a water level of said control means between two selected elevations and means responsive to said water level for actuating said valve to vary said water pressure, said control means maintaining continuous water spray as said spray distance is varied, and further comprising a float chamber having water inlet means and water outlet means for providing said water level elevation within said float chamber, a siphon tube connected to said water outlet means and defining a first water level for initiating a siphon action and a second water level for admitting air to terminate said siphon action, said siphon tube having a diameter and water exit elevation effective to discharge water at a higher rate than delivery of water through said water inlet means when said siphon action is in process, and a float means within said float chamber for actuating said valve as a function of said water level.

2. A spray system according to claim 1, wherein said distribution header and said water spray forming means are elevated relative to said selected area.

3. A spray system according to claim 2, wherein said spray forming means are formed at selected angles relative to horizontal to distribute said water contiguous with said selected area.

4. A spray system according to claim 1, further including means for coordinating a rate of change of said water level of said control means with said water pressure within said distribution header to maintain a generally uniform distribution of said water over said selected area.

5. A method for sweeping a selected area with a water spray, comprising the steps of:

filling a container with a water at a first rate, initiating a siphon at a selected first water level to drain water from said container at a second rate greater than said first rate while maintaining said water spray, terminating said siphon at a selected second water level, generating an output control signal functionally related to said water level, and varying pressure of said water to be sprayed in functional relationship with said control signal, said varying pressure forcing said sprayed water over said selected area in a continuous sweep.

6. A method according to claim 5, wherein the step of generating said output control signal includes the steps of:

moving a float with said water level, and mechanically linking said float to obtain a mechanical movement outside said container responsive to movement of said float.

7. A method according to claim 6, including the step of applying said mechanical movement to a valve effective to vary said pressure of said water to be sprayed.

8. A method according to claim 5, further including the step of supplying said water to be sprayed to a distribution system having elevated spray forming means.

9. A method according to claim 8, further including the step of adjusting said spray forming means at angles relative to horizontal to obtain substantially contiguous coverage of said sprayed water sweeping said selected area.

10. A method according to claim 5, further including the step of coordinating a rate of change of said water level with said pressure of said water to be sprayed to maintain a generally uniform distribution of said water over said selected area.

* * * * *